US005687807A

United States Patent [19]

Woods et al.

[11] Patent Number: 5,687,807

[45] Date of Patent: Nov. 18, 1997

[54] CUTTER HEAD FOR TRENCHLESS BORING MACHINE

[75] Inventors: James Akers Woods, Stuart, Va.; Randy Ray Runquist, Lovilia, Iowa

[73] Assignee: Vermeer Manufacturing Company, Pella, Iowa

[21] Appl. No.: 429,495

[22] Filed: Apr. 26, 1995

[51] Int. Cl.[6] ..... E21B 10/42; E21B 10/44; E21B 10/60

[52] U.S. Cl. ..... 175/393; 175/394; 175/397; 175/406

[58] Field of Search ..... 175/394, 397, 175/406, 53, 62, 323, 393

[56] References Cited

U.S. PATENT DOCUMENTS

| | | | |
|---|---|---|---|
| 3,202,228 | 8/1965 | Schuster | 175/53 |
| 3,763,942 | 10/1973 | Levitt | 175/394 X |
| 3,894,402 | 7/1975 | Cherrington | 175/53 X |
| 4,061,197 | 12/1977 | Skidmore, Jr. | 175/394 X |
| 4,986,375 | 1/1991 | Maher | 175/323 |
| 5,341,888 | 8/1994 | Deschutter | 175/323 |

*Primary Examiner*—Hoang C. Dang

*Attorney, Agent, or Firm*—Merchant, Gould, Smith, Edell, Welter & Schmidt, P.A.

[57] ABSTRACT

A cutter for a trenchless boring apparatus includes a mount having a first end to be coupled to a free end of a drill pipe. A plurality of cutting teeth are secured to the mount with the teeth arranged in a helical pattern surrounding an axis of the mount.

5 Claims, 4 Drawing Sheets

FIG.

CUTTER HEAD FOR TRENCHLESS BORING MACHINE

BACKGROUND OF THE INVENTION

1. Field of the Invention

This invention pertains to trenchless boring machines for forming a bore underground. More particularly, this invention pertains to a cutter head for expanding a size of a bore after initial formation of a bore by a trenchless boring machine.

2. Description of the Prior Art

Trenchless boring technology has developed for drilling a horizontal bore underground for passage of a utility line or the like through the bore. The advantage of the trenchless boring technology is that the bore is formed without the need to excavate the entire length of the line. Commonly, such technology includes an apparatus (referred to as a "drill rig") for drilling a pilot bore underground. In the formation of the pilot bore, the drill rig utilizes a steerable boring head which permits control of the direction of the boring to ensure that the pilot hole terminates at a desired location. An example of such a boring machine with a steerable head is shown in U.S. Pat. No. 4,953,638 to Dunn dated Sep. 4, 1990.

After a pilot bore has been formed by a drill rig, the bore size is enlarged through use of a cutter head. Typically, at the terminal end of the pilot bore, the steerable boring head is removed from a drill string (comprising a plurality of lengths of drill pipe). The steerable boring head is replaced with a cutter head having an outside dimension equal to a desired outside dimension for the final bore. The cutter head is pulled through the bore in a direction opposite to the direction that the steerable boring head was advanced during formation of the pilot bore.

The cutter head of the prior art includes a plurality of cutting teeth which face in the direction in which the cutter head is being advanced through the bore. The drill string and the attached cutter head are rotated such that the cutting teeth engage and remove dirt and debris as the cutter head is being pulled back through the bore. Further, such cutter heads include means for injecting fluid from the cutter head during the cutting operation. The fluid mixes with and suspends the waste resulting from the cutting operation. The suspension is important to the formation of the final bore in which a product, pipe or similar object is pulled through the final bore. Also, it is not unusual for the final product (such as a pipe, utility line or the like) to be attached to the cutter head such that the pipe or line is pulled into the bore simultaneous with the final formation of the bore by the cutter head.

During the formation of the final bore using a cutter head of the prior art, substantial amounts of energy are required to force the cutter head through the bore. While the dynamics are not fully understood, it is believed that the geometry of the cutter head interferes with waste material formed by the cutter head which impedes advancement (both linearly and rotationally) of the cutter head.

SUMMARY OF THE INVENTION

According to a preferred embodiment of the present invention, a cutter for a trenchless boring machine is disclosed. The cutter includes a mount having a first end to be attached to a free end of a drill pipe string. The mount further has a second end which extends from the first end in a direction away from the drill pipe string. A first plurality of cutting teeth are provided, each having a cutting edge. A securing means is provided to secure each of the teeth to the mount with the teeth arranged in a path extending from a path first end adjacent the first end of the mount to a path second end adjacent the second end of the mount. The path is shaped for the path first end to be circumferentially offset from the path second end.

DESCRIPTION OF THE PREFERRED EMBODIMENT

Figure 1:
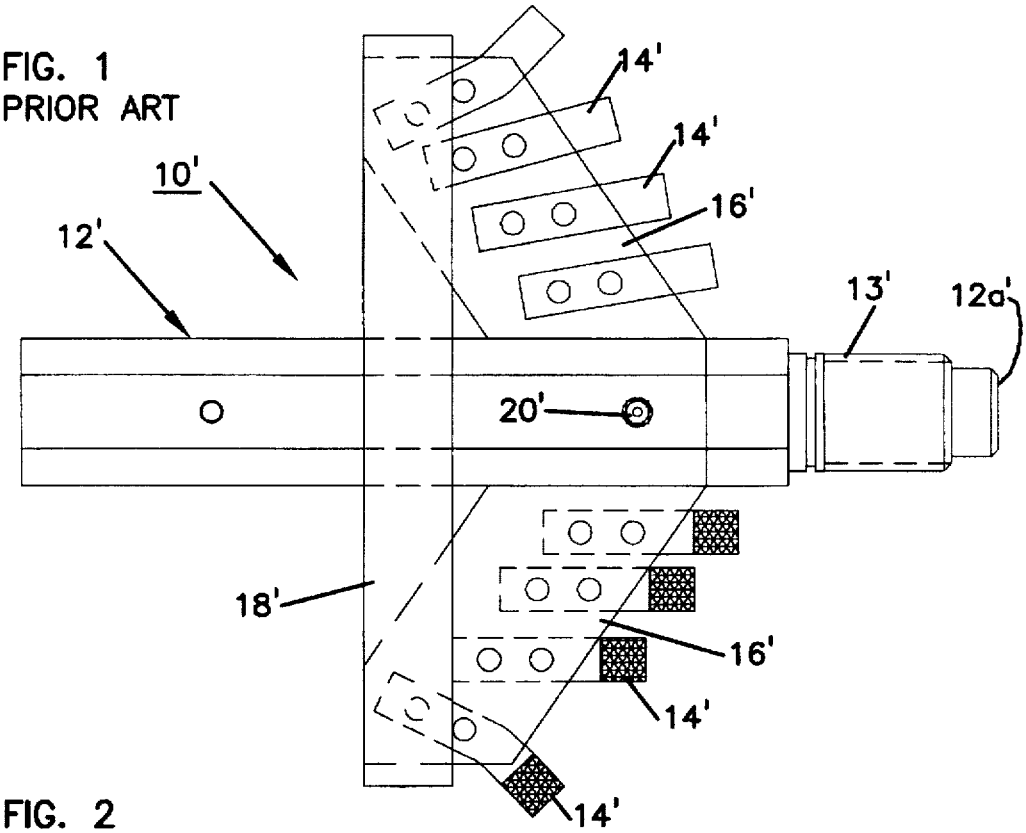
FIG. 1 PRIOR ART
FIG. 1 is a side elevation view of a first example of a prior art cutter head.

Before a detailed description of a preferred embodiment to the present invention, a description of the prior art will facilitate an understanding of the present invention. With reference to FIG. 1, a first prior art cutter head 10' is shown. The prior art cutter head 10' includes a mount 12' (commonly referred to as a "spud"). A first end **12*a*' of the mount 12' is provided with a coupling member 13' (such as external threads or the like), to be coupled to a free end of a drill string (not shown). When coupled to the drill string, the mount 12' extends axially away from the drill string. A plurality of cutter teeth 14' are secured to the mount 12'. Specifically, the cutter teeth 14' are mounted to support plates 16' which extend generally radially from mount 12' and project rearwardly away from end 12*a*'. The support plates 16' are further supported by a ring 18'. The mount 12' has an internal bore (as shown) such that it may receive fluid under pressure from the drill string when the mount 12' is attached to the drill string. The mount 12' is provided with a plurality of water jet openings such as opening 20' such that fluid injected into the interior of mount 12' is forced out of the jet nozzles 20'**.

In practice it is found that it requires a substantial amount of energy to draw the cutter 10' through a hole. While the full reason for the excessive energy required is not fully understood, it is believed that the supports 16',18' present substantial interference to rotation of the cutter 10' within a bore.

Figure 2:
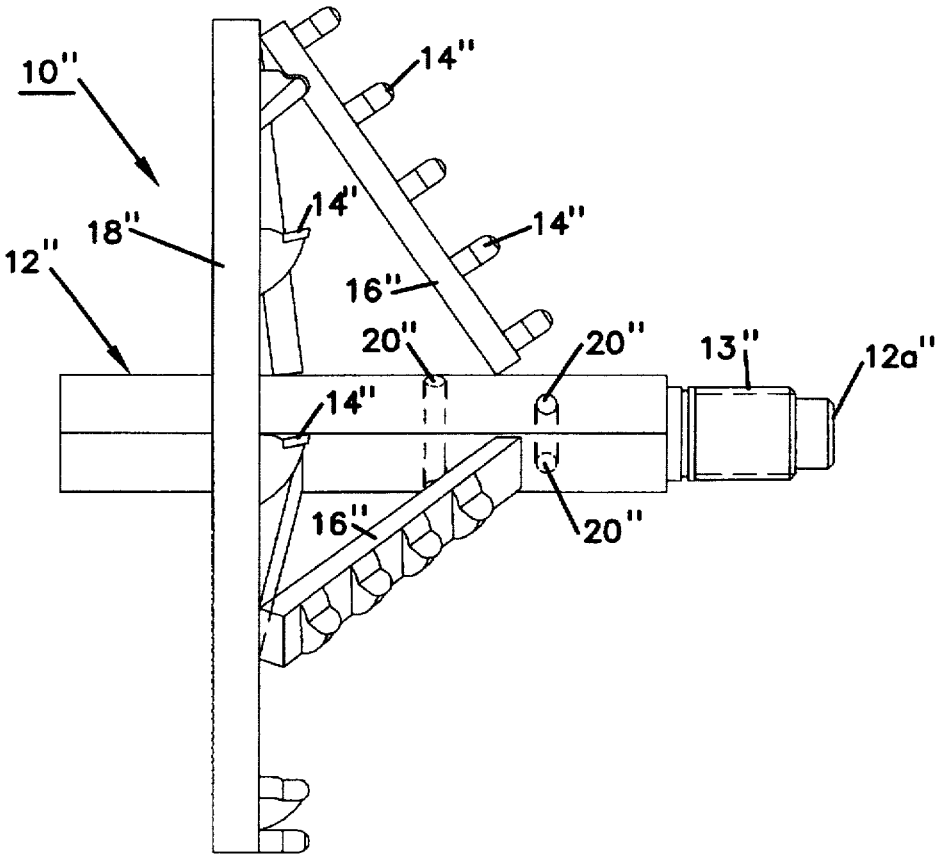
FIG. 2 PRIOR ART
FIG. 2 is a side elevation view of a second example of a prior art cutter head.

FIG. 2 is a further example of a prior art cutter 10". Cutter 10" includes a mount 12" terminating at a first free end **12*a*" and having an attachment means 13" for attachment to a drill string in a manner identical to the means for attaching the mount 12' of prior art cutter 10' Similarly, the mount 12' includes a plurality of water jet holes 20" for ejecting water which may be introduced into the mount 12" from the drill string. The cutter 10" includes a plurality of support plates 16" which project radially and rearwardly away from the mount 12". Rear ends of the support plates 16" are supported by a support ring 18". A plurality of cutter teeth 14" are placed on both the ring 18" and the support plates 16". Again, it is believed that the cutter 10" of FIG. 2 experiences substantial force requirements for drawing the cutter 10"**

through a bore. It is believed the energy requirements are due to the resistance caused by support plate 16" and ring 18" resisting both axial movement and rotational movement.

Figure 3:
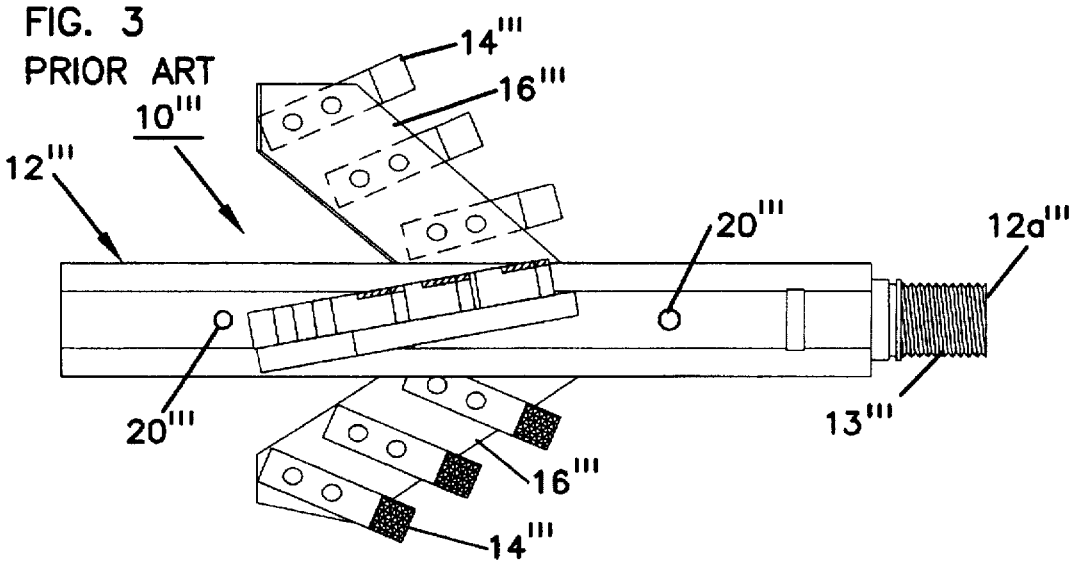
FIG. 3 PRIOR ART
FIG. 3 is a side elevation view of a third example of a prior art cutter head.
Figure 4:
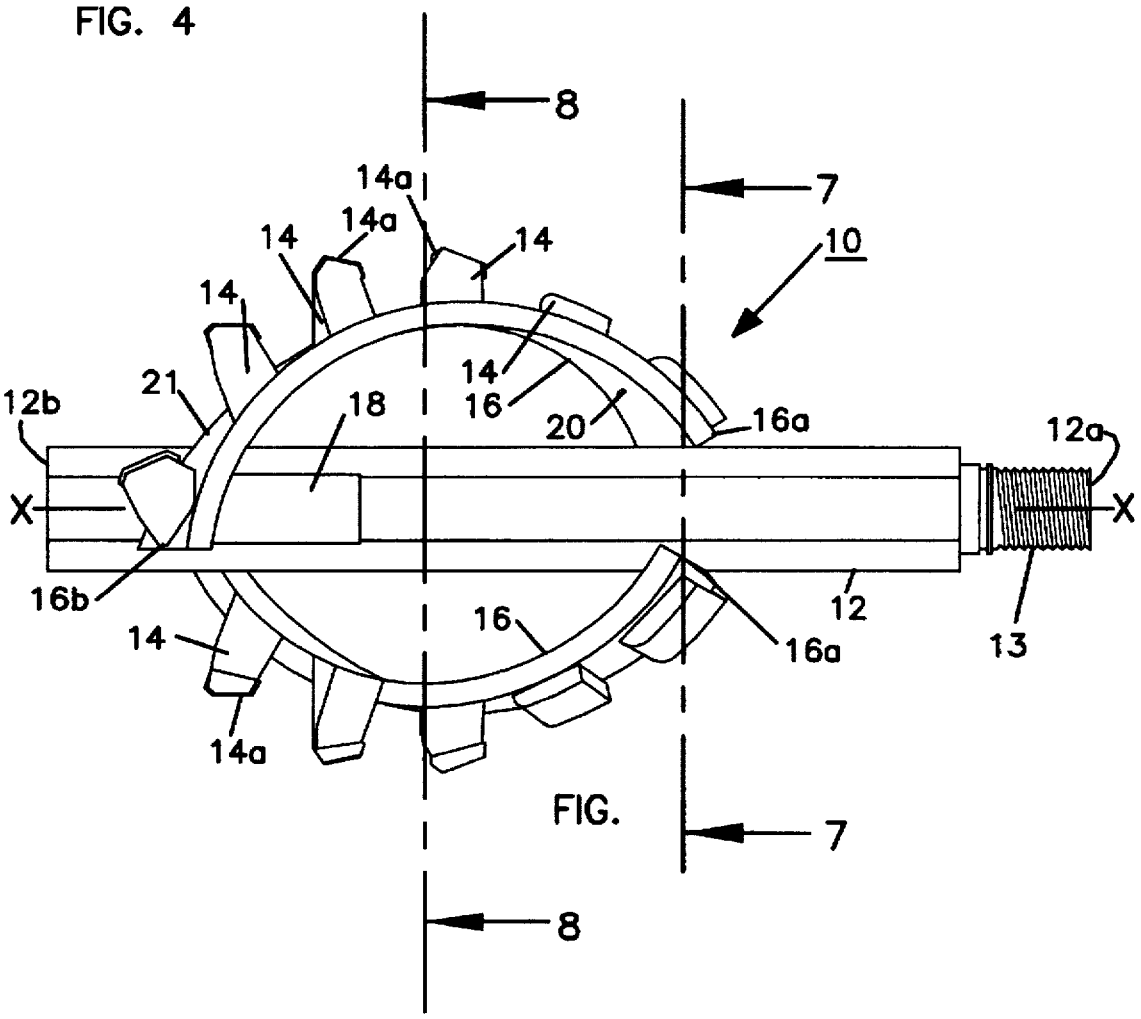
FIG. 4 is a side elevation view of a cutter head according to a preferred embodiment of the present invention.
Figure 6:
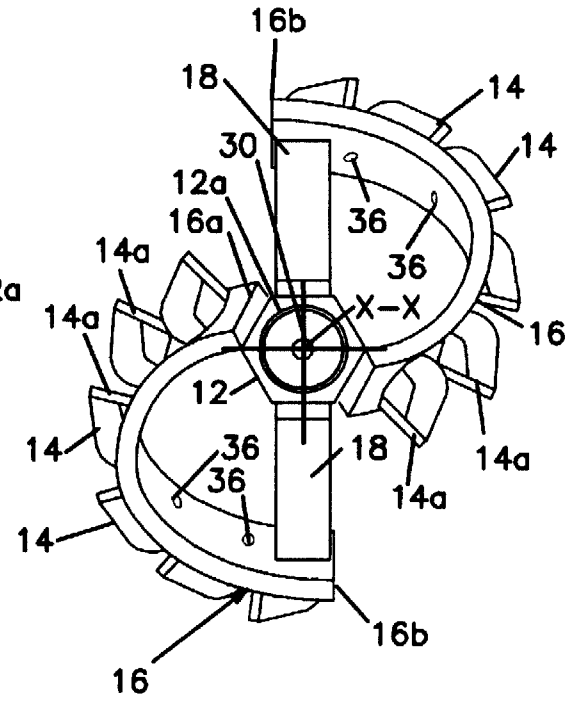
FIG. 6 is a front elevation view of the cutter head of FIG. 5.
Figure 5:
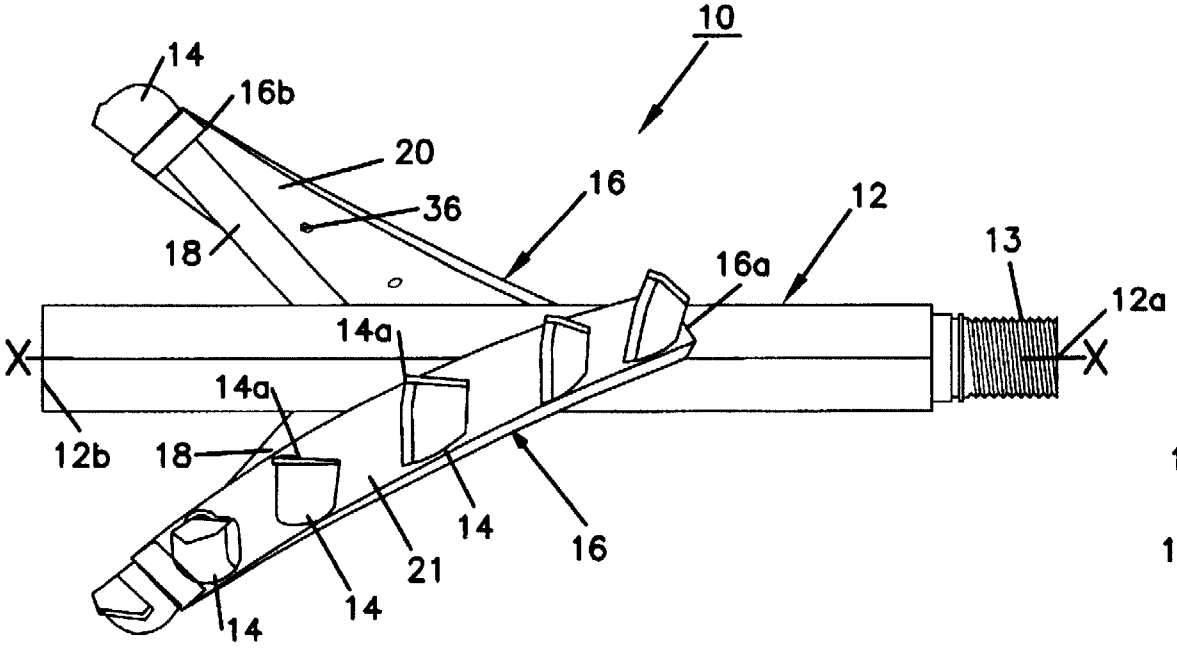
FIG. 5 is a side elevation view of the cutter head of FIG. 4 taken 90° offset from the view of FIG. 4.

As a final example of prior art, attention is directed to FIG. 3 where cutter 10''' is shown. Cutter 10''' includes a mount 12''' having a free end 12a''' with means (such as threads) 13''' for attachment of the mount 12''' to a drill string. The mount 12''' further includes water jet holes 20''' for ejecting water which is directed to the interior of the mount 12''' from the drill string. Projecting generally radially outwardly and rearwardly from the mount 12''' are a plurality of support plates 16'''. The support plates 16''' support a plurality of cutter teeth 14'''. It will be noted in FIG. 3 that the support teeth 14''' extend in a path which is generally linear and radially outwardly and rearwardly as well as being nonparallel to the axis of the mount 12'''. Again, substantial force requirements are experienced with the cutter 10''' of FIG. 3. This is believed to be due in substantial part to the interference in rotational movement caused by support plates 16''' as well as the substantial cross-sectional area presented by the cutter 10''' when viewed from the front end 12a'''. In fact, all of the prior art cutters 10', 10", 10''' of FIGS. 1–3 present a substantial amount of blocking cross-sectional area when viewed from the front ends 12a'–12a'''.

Having thus described the prior art in greater detail, a description of the preferred embodiment of the present invention will now be given with reference to FIGS. 4–8 in which identical elements are numbered identically throughout. The present invention is a cutter 10 which includes an elongated mount 12 extending from a first end 12a to a second end 12b. The first end is provided with means (such as external threads 13) for attaching the first end 12a to a free end of a drill string (not shown).

A plurality of cutter teeth 14 (each having cutting edges 14a) are provided arranged in two generally helical paths about an axis X—X of mount 12. The teeth 14 are supported by support plates 16, each extending from first ends 16a adjacent end 12a to second ends 16b adjacent end 12b. Ends 16a are secured to the mount 12 while ends 16b are spaced from the mount 12 and supported in spaced relation thereto by radially extending support plates 18.

The plates 16 are generally flat bar stock formed in a helical path with an interior surface 20 generally opposing an exterior surface of mount 12. An exterior surface 21 of plates 16 face generally away from mount 12. The teeth 14 are secured to the exterior surface 21 in any suitable means such as welding or the like.

Figure 7:
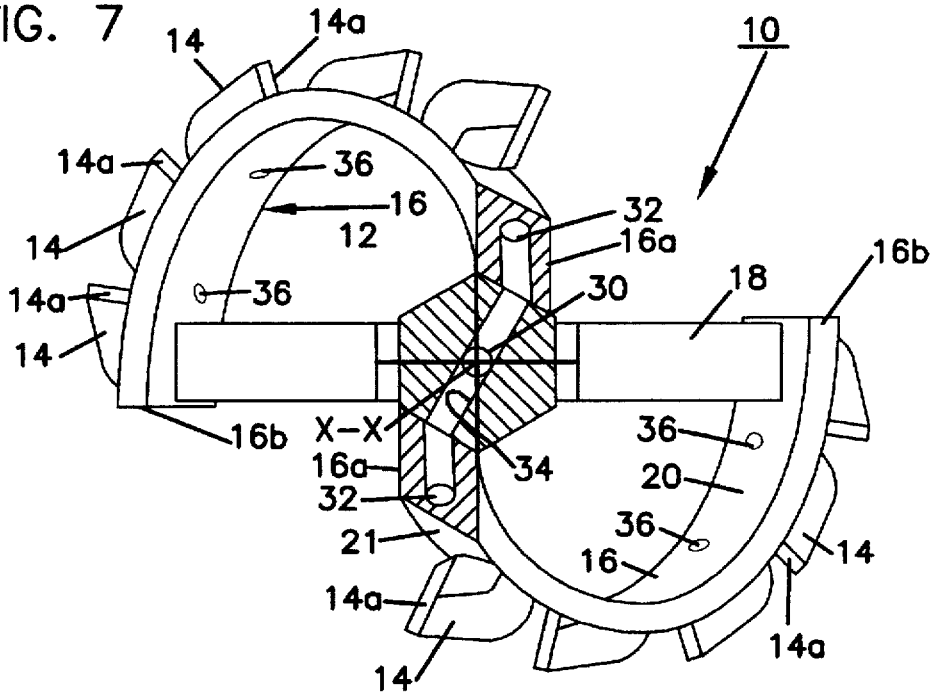
FIG. 7 is a view taken along line 7—7 in FIG. 4.
Figure 8:
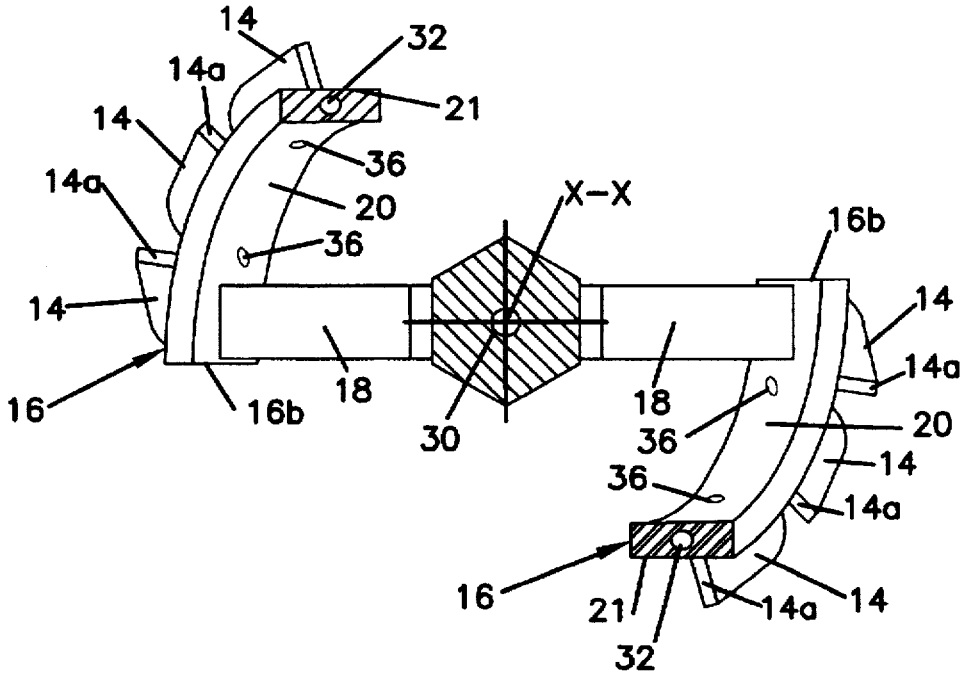
FIG. 8 is a view taken along line 8—8 of FIG. 4.

As best shown in FIG. 7, the mount 12 includes a central bore 30. Further, each of plates 16 includes a centrally extending bore 32. At end 16a, the bores 32 and 30 are connected by a cross bore 34. Further, a plurality of jet openings 36 are formed through surface 20 in communication with bore 32. Accordingly, a fluid injected under pressure into bore 30 is distributed by bore 34 to bores 32 and ejected as a nozzle spray through bores 36.

As illustrated in FIGS. 4–8, the plates 16 are shaped in a generally helical path such that the teeth 14 are arranged in two helical paths symmetric to one another about axis X—X. The plates 16 extend outwardly from mount 12 at first end 16a and are bent to extend rearwardly from end 12a and also to curve around mount 12 in a counterclockwise direction when viewed from end 12a in FIG. 6. It has been found that the arcuate path of plates 16 as well as the narrow thickness of plates 16 result in a geometry of cutter 10 which presents substantially reduced interference to advancement of the cutter 10 through a bore when compared to the geometries of the prior art devices of FIGS. 1–3. Further, fluid is ejected from the helical path of plates 16 via the nozzles 36 formed on the undersurface 20 of the plates 16 to more fully distribute the fluid during the cutting operation.

Not shown in the drawings, the second end 12b of the mount 12 can be provided with internal threads or the like to attach further cutters or to attach a cable or the like to be dragged through a finished bore simultaneous with the cutter 10 being dragged through the preformed bore.

From the foregoing detailed description of the present invention, it has been shown how the objects of the invention have been attained in a preferred manner. However, modifications and equivalents of the disclosed concepts such as those which readily occur to one skilled in the art are intended to be included within the scope of the claims which are appended hereto.

What is claimed is:

1. A cutter for a trenchless boring apparatus having a length of a drill pipe terminating at a free end and said apparatus further having means for rotating said length of drill pipe, said cutter comprising:

a mount having a mount first end and a mount second end with means for coupling said first end to said free end of said drill pipe and with said second end extending from said first end in a direction away from said drill pipe and said mount having a longitudinal axis extending axially from said drill pipe;

at least a first plurality of cutting teeth each having a cutting edge;

at least a first securing means for securing each of said teeth of said first plurality to said mount with said teeth arranged in at least a first path extending from a first path end adjacent said mount first end to a second path end adjacent said mount second end;

said first path shaped for said first path end to be circumferentially offset from said second path end;

said first securing means comprises a rigid support secured to said mount and having a support surface facing away from said axis and extending from said first path end to said second path end;

said rigid support is a bar having a first end secured to said mount at said first path end with said bar spaced from said mount at a second end of said bar;

said bar including a fluid pathway in communication with a fluid pathway within said mount, said bar further including a plurality of fluid outlets for ejecting fluid from said bar fluid pathway.

2. A cutter according to claim 1 wherein said fluid outlets are disposed on said bar on a side thereof opposite said first plurality of teeth.

3. A cutter according to claim 1 wherein said teeth are disposed with said cutting edges facing toward said mount first end.

4. A cutter according to claim 1 comprising a second plurality of cutting teeth and a second support bar for securing each of said teeth of said second plurality in a second path generally symmetrical to said first path about said axis.

5. A cutter according to claim 1 wherein said path is disposed to extend radially outwardly and rearwardly from said axis from said support first end to said support second end and with said path bending around said axis as said path extends from said support first end to said support second end.

* * * * *